United States Patent [19]

Katoh et al.

[11] 4,116,729

[45] Sep. 26, 1978

[54] METHOD FOR TREATING CONTINUOUSLY CAST STEEL SLABS

[75] Inventors: Hiroshi Katoh; Yasumitsu Onoe, both of Kitakyushu; Osamu Akisue; Kishio Mochinaga, both of Himeji, all of Japan

[73] Assignee: Nippon Steel Corporation, Tokyo, Japan

[21] Appl. No.: 832,577

[22] Filed: Sep. 12, 1977

[51] Int. Cl.[2] ..... B22D 11/00; H01F 1/04

[52] U.S. Cl. ..... 148/111; 148/2; 148/3; 148/112

[58] Field of Search ..... 148/2, 111, 112, 3

[56] References Cited

U.S. PATENT DOCUMENTS

| | | | |
|---|---|---|---|
| 3,821,031 | 6/1974 | Kubotera et al. | 148/2 |
| 3,839,095 | 10/1974 | Kubotera et al. | 148/2 |
| 3,841,924 | 10/1974 | Sakakura et al. | 148/111 |
| 3,872,704 | 3/1975 | Ohya et al. | 148/111 |
| 3,876,476 | 4/1975 | Matsuoka et al. | 148/111 |
| 4,006,044 | 2/1977 | Oya et al. | 148/111 |
| 4,014,717 | 3/1977 | Barisoni et al. | 148/111 |
| 4,066,479 | 1/1978 | Shimoyama | 148/111 |

*Primary Examiner*—W. Stallard

*Attorney, Agent, or Firm*—Wenderoth, Lind & Ponack

[57] ABSTRACT

A method for treating a continuously cast steel slab suitable for production of a hot rolled or cold rolled steel sheet, the steel slab being obtained by continuously casting a molten steel containing 0.01 to 2.5% by weight of Al, which method comprises holding the slab at a temperature within the range of from the $Ar_3$ point to 650° C for at least 20 minutes to precipitate nitrides, and hot rolling the slab.

5 Claims, 3 Drawing Figures

O Having superior magnetic properties to those of the conventional materials

× Having inferior magnetic properties to those of the conventional materials

O Having superior magnetic properties to those of the conventional materials

× Having inferior magnetic properties to those of the conventional materials

METHOD FOR TREATING CONTINUOUSLY CAST STEEL SLABS

FIELD OF THE INVENTION

The present invention relates to treatment of a continuously cast steel slab for production of a steel sheet or strip (herein called simply steel sheet) advantageously therefrom, which steel sheet has excellent qualities as compared with a steel sheet which is obtained by a conventional process.

BACKGROUND OF THE INVENTION AND PRIOR ART

According to the present practice of producing a hot rolled steel strip by a continuous hot rolling mill, a steel ingot which is produced by the ingot process, including slabbing, or by a continuous casting process, is used as the starting material. The thus obtained steel slab is cooled down to ambient temperature. Thereafter, this slab is heated up to a temperature in the range of 1200° to 1300° C over a period of more than three hours in a slab reheating furnace. It is then fed to a hot rolling mill and hot rolled into the desired thickness. The heat energy required for reheating the once-cooled steel slab to such a high temperature is tremendous.

SUMMARY OF THE INVENTION

Therefore, a primary object of the present invention is to improve the qualities of steel slabs by holding a high-temperature steel slab, as continuously cast, in a specific temperature range utilizing the latent heat of the slabs.

A second object of the present invention is to save the heat energy required by the reheating of the steel slabs.

The metallurgical significance of the first object is promotion of precipitation of nitrides of additive elements, and coarsening and coagulation of the precipitates.

In the high-temperature slab obtained by the continuous casting process, the additive elements are present in solid solution, and in case of ordinary transformable steels, the state of solid solution is maintained in the austenite temperature zone. However, below the $Ar_3$ transformation point, the precipitation of the additive elements readily takes place along with development of the ferrite phase. For example, in case of an Al-killed steel in which AlN is formed, both Al and N are present completely in solid solution in the high-temperature steel slab just after its solidification, namely in the austenite phase. At the lower side of the austenite temperature zone, it may be theoretically possible according to the equilibrium principle that the precipitation takes place, but with a shorter period of time, the non-equilibrium state, namely the super-saturated state, is maintained. As the temperature drops further below the $Ar_3$ point, the precipitation of AlN is easily caused.

The objects of the additive elements are various according to the desired qualities of individual steel grades. However, they may be classified into two groups; one is for maintaining the state of solid solution during the hot rolling; and the other is for promoting the precipitation rather than maintaining the solid solution state.

The present invention relates particularly to the latter object, and for this object, nitrogen, which is an interstitial-type element, is fixed by the additive element, Al, and precipitated as AlN, and the precipitates are coarsened while the steel slab as continuously cast is maintained at high temperatures, thereby easing the production condition and improving the qualities of the final product.

For production of a soft Al-killed hot rolled steel sheet, the coiling after the hot rolling is done normally at high temperatures, for example, at a temperature not lower than 650° C, so as to fix nitrogen as AlN and to achieve the non-aging property and the softness. However, the high-temperature coiling often suffers from inconsistency in the qualities of the product due to changes in the cooling condition over the whole length of the steel strip being coiled. Further the high temperature coiling causes coarsening of the grains in the surfacial layer of the steel strip and this coarsening of the grains results in surface defects during subsequent working steps. Still further, the high-temperature coiling often causes coagulation of the carbides in the steel which produces adverse effects on the workability of the product. In addition, where descaling treatment is required, the high-temperature coiling tends to increase the oxide layer and thus hinders the descaling.

DETAILED DESCRIPTION OF THE INVENTION

In order to eliminate the above defects, the present inventors have conducted various experiments and have completed a method in which the fixation of nitrogen is performed during the holding of the steel slab at high temperatures instead of the high-temperature coiling, so as to minimize the dissolution of nitrogen into solid solution during the heating of the slab, thereby coarsening AlN.

On the basis of the above discoveries and facts, when a soft Al-killed steel sheet is to be produced, the composition of the steel slab should consist of not more than 0.09% C, not more than 0.50% Mn, 0.01 – 0.09% acid-soluble Al, with the balance being iron and unavoidable impurities. With carbon contents beyond 0.09%, the resultant hardness is excessively high. Also with manganese contents beyond 0.5%, the resultant workability is low. Regarding the acid-soluble Al, 0.01 to 0.09% is required for completely fixing nitrogen unavoidably coming into the steel during the melting.

The steel slab used as the starting material in the present invention may be prepared by continuously casting the molten steel in an ordinary melting furnace, such as a converter, with or without a vacuum degassing treatment. According to the present invention, the high-temperature steel slab as continuously cast is cooled to a temperature in a range from $Ar_3$ point to 650° C, for example 650° to 1050° C, then held in a temperature range from the $Ar_3$ point to 650° C for at least 20 minutes, reheated to a temperature in the range of 950 to 1150° C, and then is hot rolled.

As the temperature range in which the steel slab is held, a higher temperature is advantageous from the point of heat energy, and thus a range from the $Ar_3$ point to 650° C is preferable. In this case, in order to fully precipitate AlN and to obtain excellent workability thereby, a holding time of at least 20 minutes is required. Below the lower temperature limit of 650° C, the precipitation treatment is very hard to achieve on a commercial scale, and a long-period of time, for example, more than 5 hours, is required for this treatment. However, according to the present invention, satisfactory non-aging property can be assured by the precipitation of AlN even at a temperature below 650° C.

Regarding the reheating temperature, 1150° C, at which AlN is redissolved, is defined as the upper limit, and the lower limit is defined at 950° C because the hot finishing rolling is done at a temperature not lower than the $Ar_3$ point.

The Al-killed hot rolled steel sheet obtained by the above treatments may be subjected to cold rolling and continuous annealing to obtain a cold rolled steel sheet having excellent workabilities.

AlN is also important in a non-oriented electrical steel sheet containing, for example, not more than 0.06% C, 1.0 to 4.0% Si, and not more than 0.5% acid-soluble Al, with the balance being iron and unavoidable impurities, because it produces significant effects on the magnetic properties.

According to the conventional method for producing an electrical steel sheet, a cold steel slab produced by slabbing or continuous casting is once-cooled and this cold slab is reheated at least to a temperature which permits hot rolling, but not higher than the temperature of AlN dissolution, and held in this temperature range for a long period of time to coarsen AlN without dissolving it into solid solution, so as to relieve the restrictive effect on the grain growth in the subsequent annealing step.

According to the present invention, the steel slab obtained by continuous casting is not cooled to the ambient temperature, and the high-temperature steel slab as continuously cast is hot rolled, while utilizing the technical advantages of the continuous casting process. What is important here is that the magnetic properties as required by a non-oriented electrical steel sheet are developed by the precipitation and coagulation treatment of the steel slab under special conditions.

According to the results of experiments conducted by the present inventors, when the high temperature steel slab as continuously cast is held in a temperature range of 800° to 1050° C with respect to the central portion of the slab in particular, for at least 40 minutes, precipitation and coagulation of AlN are satisfactorily promoted.

Figure 1:
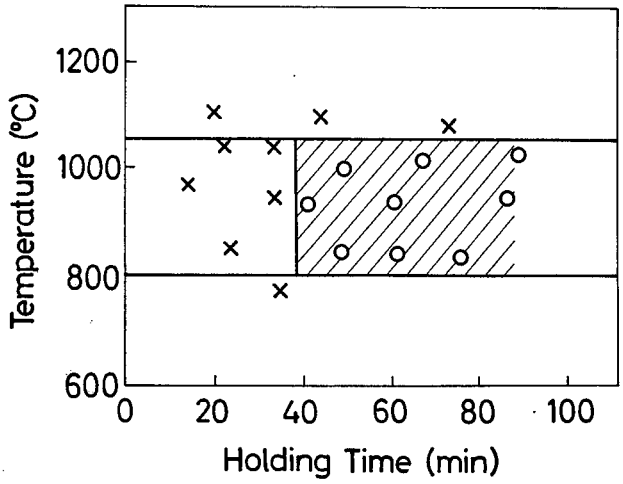
FIG. 1 is a graph showing the effects of the holding treatment on the magnetic properties.

The effects of holding the steel slab in the specific temperature range on the magnetic properties are shown in FIG. 1. As shown in the figure, when the temperature is at 800° C or higher and the holding time is short, the amount of AlN precipitated is small, and the particle size of the precipitates is small. This condition is not desirable, because it restricts the grain growth in the subsequent annealing step. Also, below 800° C, the precipitates are hard to coarsen even with a long holding period. On the other hand, in the case of a non-oriented electrical steel sheet, when the temperature is higher than 1050° C, the dissolution of AlN is promoted and desired magnetic properties are not obtained. Therefore, in the present invention, the high-temperature steel slab as continuously cast is held within the temperature range of 800° to 1050° C for at least 40 minutes.

The steel slab thus held is immediately hot rolled, and then cold rolled as required. The non-oriented electrical steel sheet thus produced has excellent magnetic properties as compared with the non-oriented electrical steel sheet produced by a conventional process. In the steel slab which has been subjected to the holding treatment for precipitation and coagulation of AlN as mentioned above, the dissolution of AlN is retarded when the slab is reheated rapidly in the temperature range of from higher than 1050° to 1200° C in a short time. In this case, a hot rolled steel sheet having good profile and shape can be obtained by hot rolling the slab after the reheating without sacrificing the magnetic properties. In general, a higher hot rolling temperature produces a better profile and shape, and particularly 1100° C is desired. This tendency is illustrated in FIG. 2.

Figure 3:
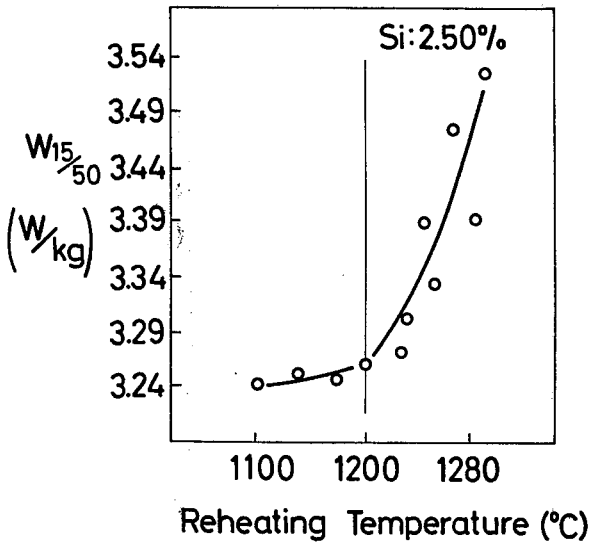
FIG. 3 is a graph showing the relation between the reheating temperature and the magnetic properties.

However, as shown in FIG. 3, when the slab is reheated to a temperature above 1200° C, the magnetic properties are remarkably degraded.

Figure 2:
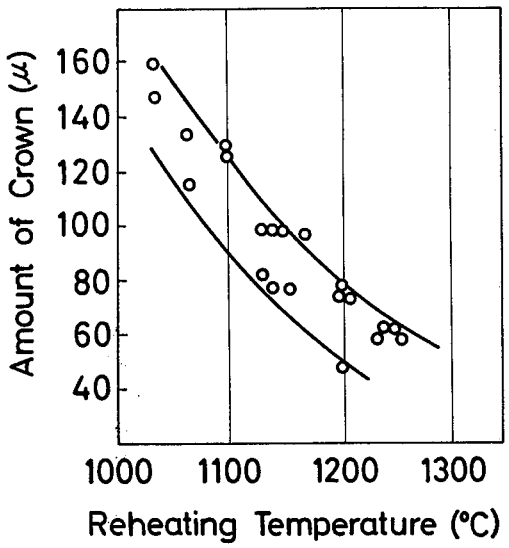
FIG. 2 is a graph showing the relation between the reheating temperature and the amount of crown.

As understood from the results shown in FIG. 2 and FIG. 3 an excellent hot steel coil with a low crown can be obtained without sacrificing the magnetic properties by holding the high temperature slab as continuously cast in the range of 800 to 1050° C, particularly in respect to the central portion of the slab, for at least 40 minutes, then rapidly reheating the slab to a temperature higher than 1050° C but not higher than 1200° C, and immediately hot rolling the reheated slab.

The present invention will be more clearly understood from the following examples.

EXAMPLE 1

A molten steel having the composition shown in Table 1 was prepared in a converter, and this molten steel was degassed under vacuum and continuously cast to obtain hot steel slabs which were hot rolled under the holding and heating conditions shown in Table 1 into hot coils of 3.0 mm in thickness. The thus obtained hot coils were descaled and temper rolled with a reduction of 1.5%. The mechanical properties of the hot rolled strip thus obtained are shown in Table 1. It is clearly shown from the results in Table 1 that the holding treatment of the high-temperature slabs according to the present invention produces remarkable effects. Steel strips A to G have excellent non-aging property, as expressed by A.I. (Aging Index), and workability. In the comparative strip which was produced by a conventional process with the high-temperature coiling, roughing was observed during the subsequent workings. The hot rolled strips A, B, E, c and e shown in Table 1 were cold rolled with 70% reduction, continuously annealed at 700° C for one minute, and subjected to an over-aging treatment at 300° C for three minutes to obtain cold rolled sheets. The mechanical properties of these sheets after 1.5% temper rolling are shown in Table 2. It is clearly shown by the results in the tables that the cold rolled steel sheets produced according to the present invention have excellent mechanical properties as compared with the comparative cold rolled steel sheets.

EXAMPLE 2

A molten steel prepared in a converter and degassed under vacuum to obtain a molten steel composition consisting of 0.009% C, 2.45% Si, 0.275% acid-soluble Al with the balance being iron and unavoidable impurities. The molten steel thus obtained was continuously cast into steel slabs A to E of 250 mm in thickness. KAt the exit side of the continuous casting machine, the upper surface and the side surfaces of the slabs A, B and C were covered with a heat insulating material to prevent heat diffusion. In this way, high-temperature slabs were obtained. Thse high-temperature slabs were transferred to a continuous hot rolling shop, where the slabs were held for 10 minutes in a heat-retaining cover so as to minimize the temperature difference between the end portion and the central portion, utilizing the heat of the slab itself, and then the cover was removed. Slab A was immediately subjected to continuous hot rolling into a hot rolled sheet of 2.30 mm in thickness, while the slabs B and C were charged in a heating furnace which was maintained at 1280° C. Slab B was extracted when it was uniformly heated to 1200° C, while the slab C was extracted when it was uniformly heated to 1280° C. Then these slabs were immediately hot rolled into hot rolled sheets of 2.30 mm in thickness.

The period from the time when the heat insulating material was applied to the slabs to the beginning of the hot rolling was 45 minutes, and the slab temperature at the time when the heat-retaining cover was taken off was 1010° C. The finishing temperature of the hot rolling was 830° to 900° C and the coiling temperature was 550° to 650° C for all of the slabs A, B and C.

The hot rolled coils of 2.30 mm in thickness thus obtained were subjected to annealing, descaling, cold rolling and annealing to obtain final products of 0.50 mm in thickness which were subjected to qualifying tests.

Meanwhile, the slabs D and E obtained from the same molten steel were continuously cast and were once-cooled to obtain cold slabs according to a conventional process, then the cold slabs were reheated at 1100° C for 3 hours and 30 minutes, and rolled into hot coils of 2.30 mm in thickness. The finishing temperature of hot rolling was 830° to 900° C and the coiling temperature was 550° to 650° C. Then the hot coils were treated in the same way as the slabs A, B and C and subjected to qualifying tests.

The magnetic properties and the amount of crown of the products obtained from the slabs A to E are shown in Table 3.

As clearly understood from the above results, the product from the slab A according to the present invention has remarkably excellent magnetic properties. Also the product from the slab B which was reheated according to the present invention shows a very small amount of crown without considerable lowering of the magnetic properties.

Table 1

| | Coil No. | Chemical Composition (wt.%) C | Mn | Si | P | S | Sol.Al | N | Holding Temperature and Time Temp.(° C) | Time(min.) | Slab Heating Temp.(° C) |
|---|---|---|---|---|---|---|---|---|---|---|---|
| Present Invention | A | 0.053 | 0.30 | 0.01 | 0.01 | 0.01 | 0.051 | 0.0045 | 750 | 40 | 1070 |
| | B | 0.040 | 0.29 | " | " | " | 0.037 | 0.0032 | 810 | 25 | 1000 |
| | C | 0.060 | 0.26 | " | " | " | 0.045 | 0.0047 | 780 | 30 | 1050 |
| | D | 0.045 | 0.20 | " | " | " | 0.073 | 0.0070 | 730 | 35 | 1120 |
| | E | 0.033 | 0.17 | " | " | " | 0.041 | 0.0035 | 800 | 35 | 1020 |
| | F | 0.071 | 0.27 | " | " | " | 0.063 | 0.0053 | 740 | 45 | 1100 |
| | G | 0.050 | 0.30 | " | " | " | 0.055 | 0.0075 | 790 | 55 | 1100 |
| Comparison | a | 0.049 | 0.30 | 0.01 | 0.01 | 0.01 | 0.060 | 0.0065 | 20 | — | 1250 |
| | b | 0.055 | 0.29 | " | " | " | 0.070 | 0.0060 | 20 | — | 1180 |
| | c | 0.060 | 0.30 | " | " | " | 0.050 | 0.0045 | 920 | 25 | 1070 |
| | d | 0.040 | 0.28 | " | " | " | 0.058 | 0.0055 | 830 | 15 | 1200 |

| Coil No. | Hot Rolling Conditions: Finishing Temp.(° C) | Coiling Temp.(° C) | Tension Testing Values: YP (kg/mm²) | TS (kg/mm²) | Elongation(%) | A.I. | Press Testing Values (mm): Formability by Stretching | Formability by Drawing & Stretching |
|---|---|---|---|---|---|---|---|---|
| A | 865 | 670 | 21 | 32 | 48 | 0.4 | 87 | 107 |
| B | 860 | 700 | 20 | 31 | 50 | 0.3 | 88 | 108 |
| C | 865 | 600 | 21 | 33 | 47 | 0.5 | 85 | 104 |
| D | 890 | 700 | 20 | 32 | 49 | 1.0 | 86 | 107 |
| E | 860 | 680 | 20 | 31 | 50 | 0.5 | 88 | 109 |
| F | 880 | 580 | 22 | 34 | 47 | 0.6 | 85 | 105 |
| G | 875 | 650 | 20 | 32 | 48 | 0.8 | 86 | 107 |
| a | 895 | 750 | 22 | 33 | 45 | 0.7 | 83 | 103 |
| b | 880 | 650 | 26 | 37 | 40 | 4.0 | 72 | 93 |
| c | 870 | 600 | 27 | 38 | 40 | 4.5 | 70 | 90 |
| d | 895 | 700 | 24 | 36 | 42 | 2.8 | 79 | 100 |

Table 2

| | Sample No. | YP (kg/mm²) | TS (kg/mm²) | El (%) | $\bar{r}$ value | GS No. |
|---|---|---|---|---|---|---|
| Present Invention | A | 26 | 35 | 43 | 1.4 | 9.7 |
| | B | 23 | 33 | 46 | 1.6 | 9.4 |
| | E | 25 | 35 | 44 | 1.5 | 9.6 |
| Comparison | c | 27 | 36 | 41 | 1.2 | 10.5 |
| | e | 28 | 36 | 42 | 1.2 | 10.3 |

Table 3

| | Magnetic Properties: W15/50 (w/kg) | $B_{50}$ wb/m² | L/C | Amount of Crown in the Hot Rolled Sheet (μ) |
|---|---|---|---|---|
| A | 2.943 | 1.688 | 1.18 | 143 |
| B | 3.270 | 1.697 | 1.19 | 82 |
| C | 3.534 | 1.703 | 1.18 | 63 |
| D | 3.273 | 1.697 | 1.20 | 130 |
| E | 3.265 | 1.694 | 1.19 | 129 |

What is claimed is:

1. A method for treating a continuously cast steel slab obtained by continuously casting a molten steel containing 0.01 to 2.5% by weight of Al, which comprises holding the slab in a temperature range from the $Ar_3$ point to 650° C for at least 20 minutes when the temperature of said slab is first in said temperature range following said casting, to precipite nitrides, and hot rolling the slab.

2. A method according to claim 1 in which the slab consists of not more than 0.09% by weight of C, not more than 0.5% by weight of Mn, 0.01 to 0.09% by weight of acid-soluble Al, with the balance being iron and unavoidable impurities, and, following the holding step, the slab is reheated to a temperature in the range of from 950° to 1150° C and hot rolled to obtain a hot rolled steel sheet suitable for producing a soft cold rolled steel sheet.

3. A method according to claim 1 in which the slab consists of not more than 0.06% by weight of C, 1.0 to 4.0% by weight of Si, not more than 0.5% by weight of acid-soluble Al, with the balance being iron and unavoidable impurities, and the slab is held for at least 40 minutes in a temperature range of from 800 to 1050° C during the holding step and is hot rolled within said temperature range to obtain a hot rolled product suitable for a non-oriented electrical steel sheet.

4. A method according to claim 1 in which the slab consists of not more than 0.06% by weight of C, 1.0 to 4.0% by weight of Si, not more than 0.5% by weight of acid-soluble Al, with the balance being iron and unavoidalbe impurities, and the slab is held for at least 40 minutes in a temperature range of 800° to 1050° C during the holding step, after which the slab is reheated to a temperature in the range of from higher than 1050° C to 1200° C and is hot rolled within said temperature range to obtain a hot rolled product suitable for a non-oriented electrical steel sheet.

5. A method according to claim 1 in which the holding temperature is in a range of from 650° to 1050° C.

* * * * *